US011067331B1

(12) United States Patent
Hanson et al.

(10) Patent No.: US 11,067,331 B1
(45) Date of Patent: Jul. 20, 2021

(54) CANTILEVER SHELF AND SHELF SUPPORT ASSEMBLY

(71) Applicant: Electrolux Home Products, Inc., Charlotte, NC (US)

(72) Inventors: Josh Hanson, Charlotte, NC (US); Orin Miller, Pickens, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/744,510

(22) Filed: Jan. 16, 2020

(51) Int. Cl.
*F25D 25/02* (2006.01)
*F25D 23/06* (2006.01)

(52) U.S. Cl.
CPC ..... *F25D 25/02* (2013.01); *F25D 23/066* (2013.01); *F25D 23/067* (2013.01)

(58) Field of Classification Search
CPC ..... F25D 23/06; F25D 23/065; F25D 23/066; F25D 23/067; F25D 25/00; F25D 25/02; F25D 2323/06; F25D 2325/00
See application file for complete search history.

(56) References Cited

U.S. PATENT DOCUMENTS 3,219,405 A * 11/1965 Costantini ..... F25D 25/02 312/351
4,365,562 A * 12/1982 Webb ..... A47B 57/42 108/108
5,199,778 A * 4/1993 Aoki ..... A47B 57/32 312/408
5,348,385 A 9/1994 Berg
6,065,821 A * 5/2000 Anderson ..... A47B 57/06 108/108
D554,670 S 11/2007 Jorgensen
7,299,651 B2 * 11/2007 Oh ..... F25D 17/062 62/407
8,123,315 B2 2/2012 Hagele et al.
8,215,732 B2 * 7/2012 Kim ..... F25D 25/02 312/408
8,240,791 B2 * 8/2012 Benz ..... F25D 23/066 312/405
8,282,178 B2 10/2012 Bradley et al.
D673,983 S 1/2013 Roberson
D692,931 S 11/2013 Roberson
D701,247 S 3/2014 Roberson
(Continued)

FOREIGN PATENT DOCUMENTS

DE 102016225367 A1 * 6/2018 ..... A47F 3/0426
WO WO-2006120099 A1 * 11/2006 ..... F25D 17/065
WO WO-2018202364 A1 * 11/2018 ..... F25D 25/02

*Primary Examiner* — Andrew M Roersma
(74) *Attorney, Agent, or Firm* — Pearne & Gordon LLP

(57) ABSTRACT

Provided is a refrigeration appliance having a cabinet defining a storage compartment therein with one or more shelves supported in the compartment. A false wall is provided adjacent an internal wall of the compartment to conceal aspects of a support system that supports both the false wall and the one or more shelves within the compartment, via inter-engagement of the support system with the internal wall and with another internal wall disposed adjacent the internal wall. A wall of the support system including a plurality of mounting holes is retained outward of a major inward face of the false wall to provide a recessed and fluid appearance of the side of the interior of the compartment having the internal wall.

17 Claims, 13 Drawing Sheets

(56) References Cited

U.S. PATENT DOCUMENTS

| | | | | |
|---|---|---|---|---|
| 8,820,865 | B2 * | 9/2014 | Simpson | F25D 23/067 312/408 |
| 8,979,225 | B2 | 3/2015 | Eckartsberg et al. | |
| 9,572,428 | B2 | 2/2017 | Seeley | |
| 9,726,422 | B2 * | 8/2017 | Tunzi | F25D 11/02 |
| 9,752,821 | B2 | 9/2017 | Seeley | |
| 10,126,042 | B2 | 11/2018 | Cetinyol et al. | |
| 2008/0030114 | A1 * | 2/2008 | Becke | A47B 57/425 312/408 |
| 2010/0270251 | A1 * | 10/2010 | Mejac | A47B 57/265 211/134 |
| 2018/0164021 | A1 * | 6/2018 | Lindel | F25D 23/006 |
| 2018/0164029 | A1 * | 6/2018 | Lindel | F25D 23/069 |
| 2018/0172339 | A1 * | 6/2018 | Lindel | F25D 23/066 |
| 2018/0274850 | A1 * | 9/2018 | Staud | F25D 17/062 |

* cited by examiner

CANTILEVER SHELF AND SHELF SUPPORT ASSEMBLY

FIELD OF THE INVENTION

This application relates generally to an internal storage shelf for a refrigeration appliance, and more particularly, to a refrigeration appliance including an internal shelf being cantilevered relative to support elements of a body of the appliance and having a rail system mounted flush with a false rear wall of the body.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Many modern refrigerators use a pair of French-type doors wherein two opposing doors allow access to the fresh food compartment. Some refrigerators are designed such that said refrigerator doors present a symmetrical configuration (i.e., the two opposing doors having the same width), while other are designed such that said refrigerator doors present an asymmetrical configuration (i.e., the two opposing doors have different widths).

In either configuration, such refrigerators are known to include a plurality of various types of storage support, which support may include any of shelves, drawers, bins, racks, hangers, etc. Typical shelving includes support arms that removably engage with a support element, such as a ladder track or support rail, attached to the rear wall, at least of the fresh food compartment. The support arms typically include a latching element that is received into one of various slots disposed at a respective support element, the support element extending inward into the respective cabinet from a rear wall of the respective compartment. The latching elements can be shifted vertically, to provide for different internal arrangements of shelves and spacing of shelves from one another. This customization allows the user to adjust the shelves as needed to meet particular storage needs with respect to products of various heights that may be stored in the respective compartment. Likewise, one or more shelves may be removed to make room for especially large or tall items.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

Generally, a shelf support system for supporting a shelf within a cabinet of a refrigeration appliance is provided for engaging with at least a pair of adjacent and comparatively-transversely-arranged walls of a liner within the cabinet, to thereby support the shelf in a generally horizontal state, while also providing mounting support to a false wall extending along and disposed inward of one of the pair of walls of the liner.

In accordance with one aspect, there is provided refrigeration appliance including a cabinet defining a storage compartment therein for storing food items in a cooled environment, a door coupled relative to the cabinet for selectively closing an opening of the compartment, and a liner defining at least one liner wall of the compartment. Also included is a vertical support rail coupled to the at least one liner wall, a shelf support selectively removably mounted to the vertical support rail, a shelf panel supported generally horizontally on the shelf support, and a false wall extending along the at least one liner wall and disposed inward of the at least one liner wall within the compartment. The vertical support rail is disposed majoratively outward of an inward-most face of the false wall.

In accordance with another aspect, there is provided a refrigeration appliance including a cabinet defining a storage compartment therein for storing food items in a cooled environment, a liner defining at least one liner wall and an adjacent liner wall of the compartment disposed adjacent the at least one liner wall, and a vertical support rail coupled to the at least one liner wall. Also included is a shelf support selectively removably mounted to the vertical support rail and extending inward of the at least one liner wall into the compartment, and a shelf panel supported generally horizontally on the shelf support. The vertical support rail is supported in vertical alignment via engagement with both the at least one liner wall and with the adjacent liner wall, where the vertical support rail and the adjacent liner wall each have mating features corresponding to and mating with one another.

In accordance with yet another aspect, there is provided refrigeration appliance including a cabinet defining a storage compartment therein with one or more shelves supported in the compartment, and a false wall provided adjacent an internal wall of the compartment to conceal aspects of a support system that supports both the false wall and the one or more shelves within the compartment, via inter-engagement of the support system with the internal wall and with another internal wall disposed adjacent the internal wall.

The foregoing and other features are hereinafter described in greater detail with reference to the accompanying drawings.

BRIEF DESCRIPTION OF THE DRAWINGS

These accompanying drawings, which are not necessarily to scale, show various aspects of the disclosure.

DESCRIPTION OF EXAMPLE EMBODIMENTS

Figure 1:
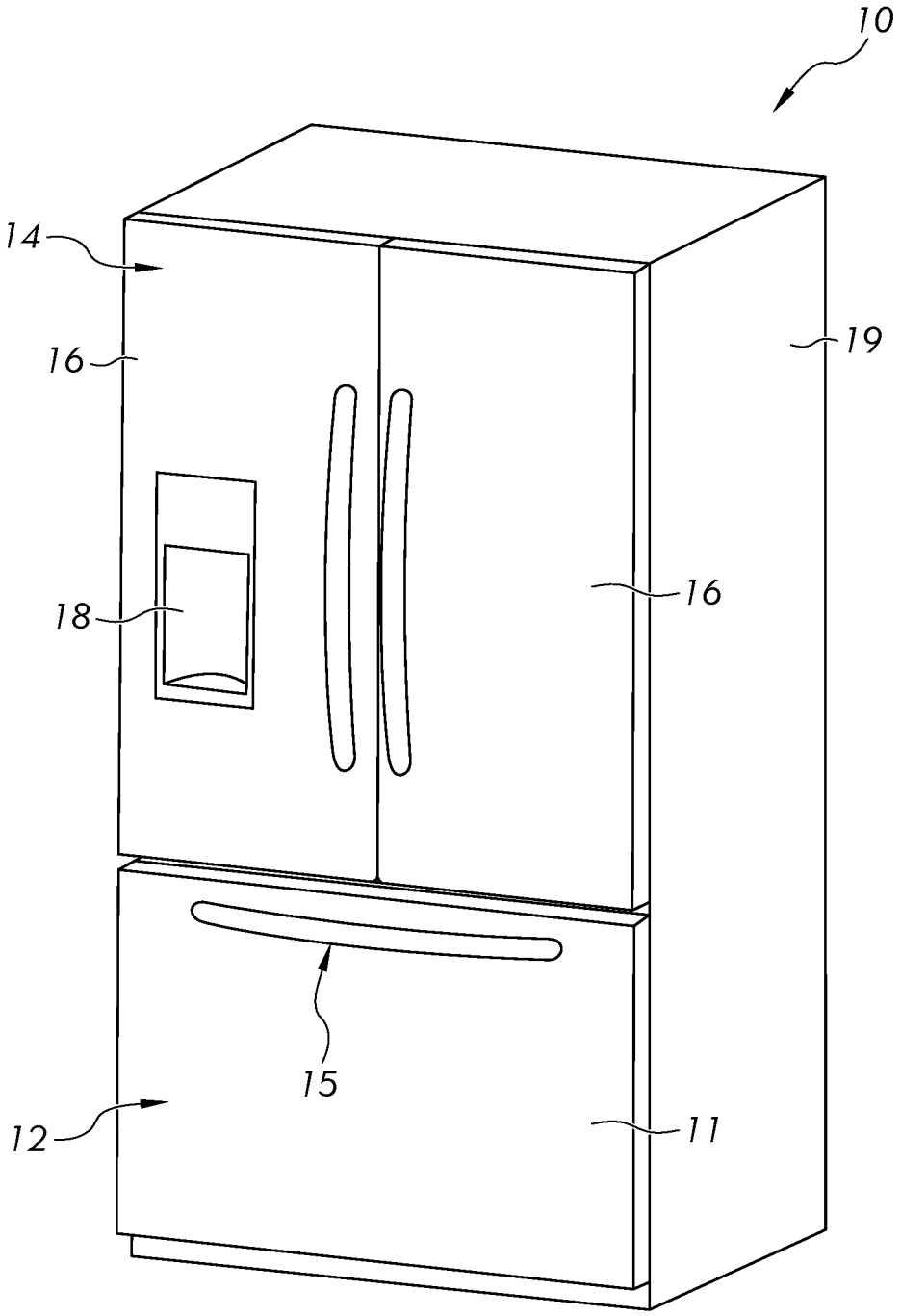
FIG. 1 (PRIOR ART)
FIG. 1 is a front perspective view of one example household bottom mount refrigerator wherein the upper doors and the bottom drawer of the refrigerator are in a closed position.

Generally disclosed is a refrigeration appliance that includes a compartment for storing food items in a refrigerated environment, the compartment being selectively closed by a door. One or more shelves are provided in the compartment and are supported in a generally horizontal state by a shelf support system according to the present application. The shelf support system is configured to reduce space in the compartment taken up by the shelf support system and to provide extra stability to the one or more shelves beyond that of conventional shelf support systems. The shelf support system and a false rear wall of the refrigeration appliance according to the present application are jointly configured to conceal aspects of the shelf support system and to provide a flush and planar rear of the compartment to accomplish an overall clean and fluid presentation to the user.

Embodiments of a refrigerator or a component thereof will now be described with reference to the accompanying drawings. Whenever possible, the same reference numerals are used throughout the drawings to refer to the same or like parts. However, this apparatus may be embodied in many different forms and should not be construed as limited to the embodiments set forth herein.

Figure 2:
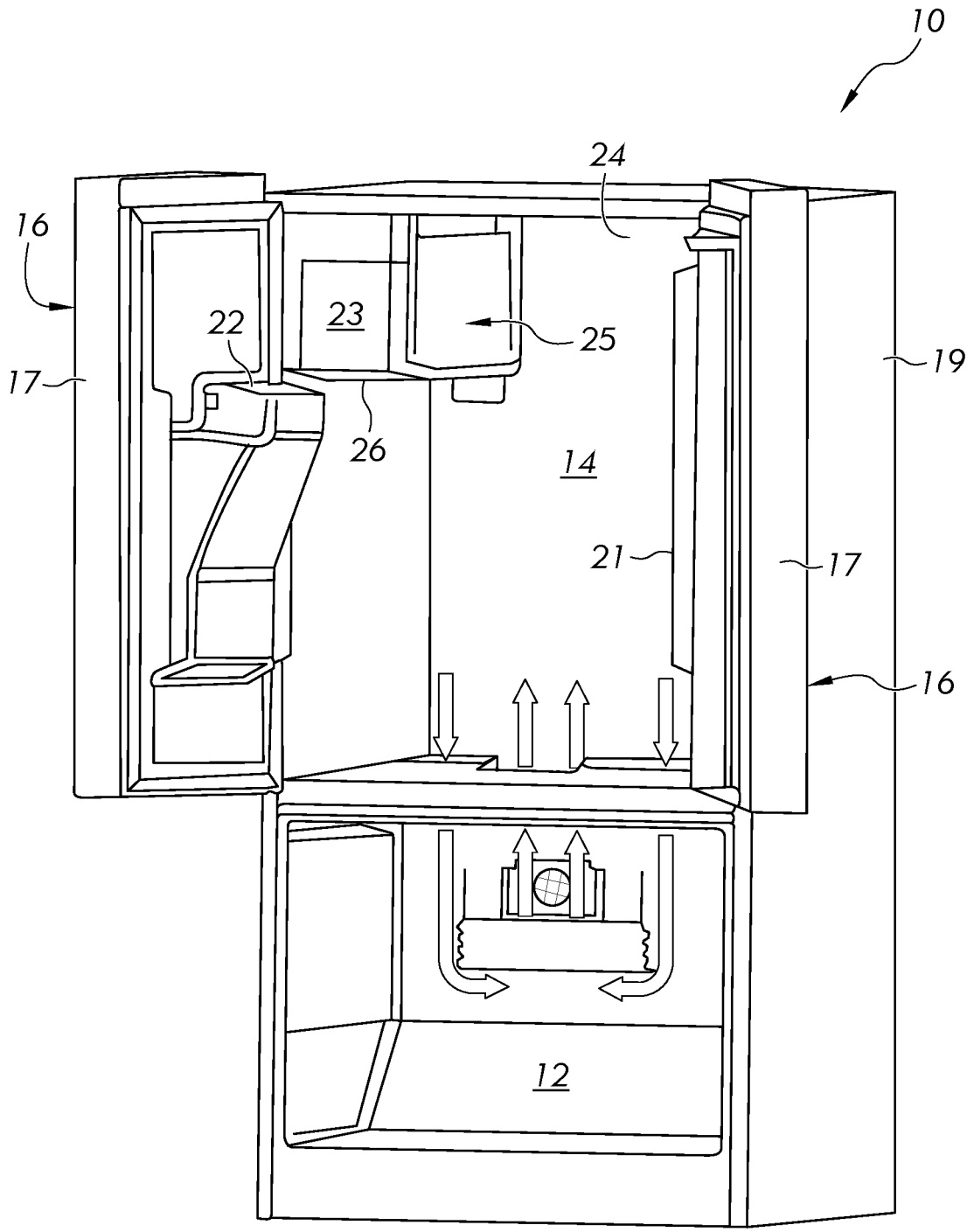
FIG. 2 (PRIOR ART)
FIG. 2 is a front perspective view of the refrigerator of FIG. 1 showing the doors in an opened position and an interior of a fresh food compartment.
Figure 4:
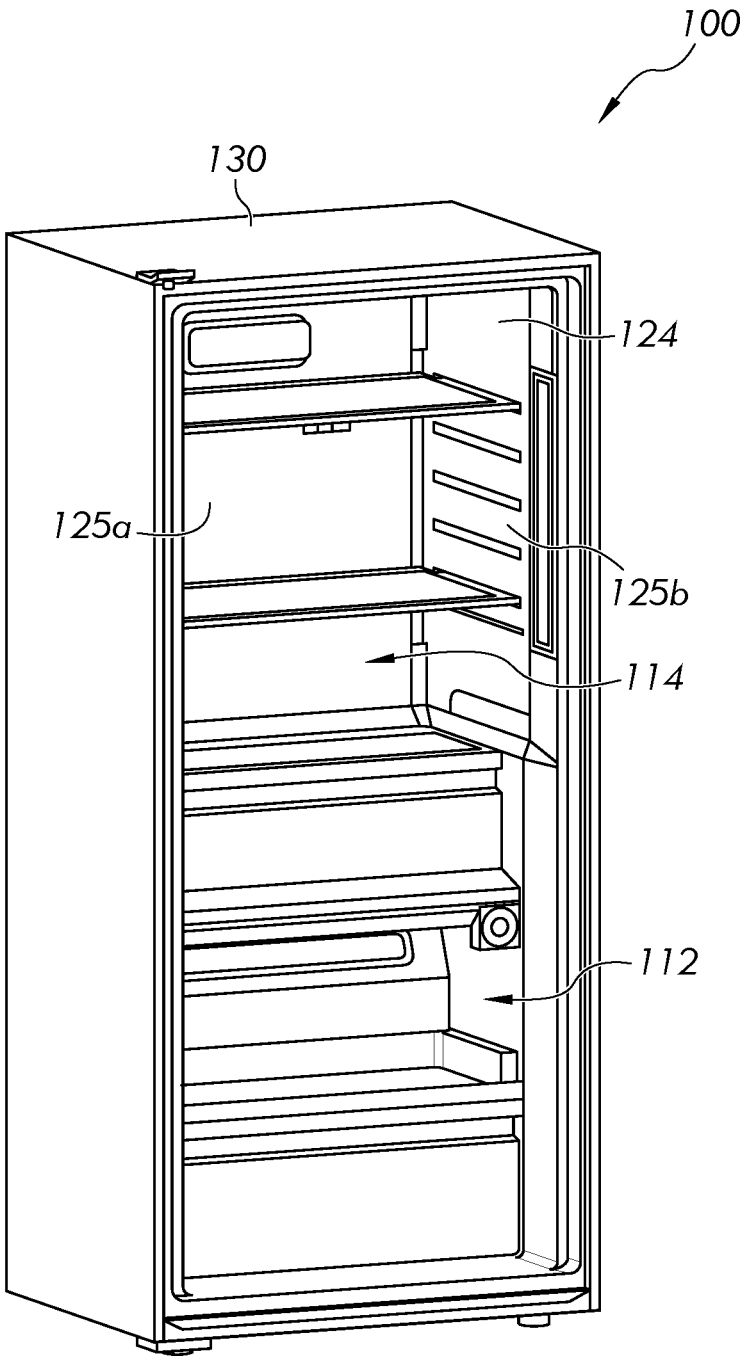
FIG. 4 is a front perspective view of another refrigerator having a single compartment being closed by a single door with the door being removed to allow view of the internal compartment including a shelf support system.
Figure 5:
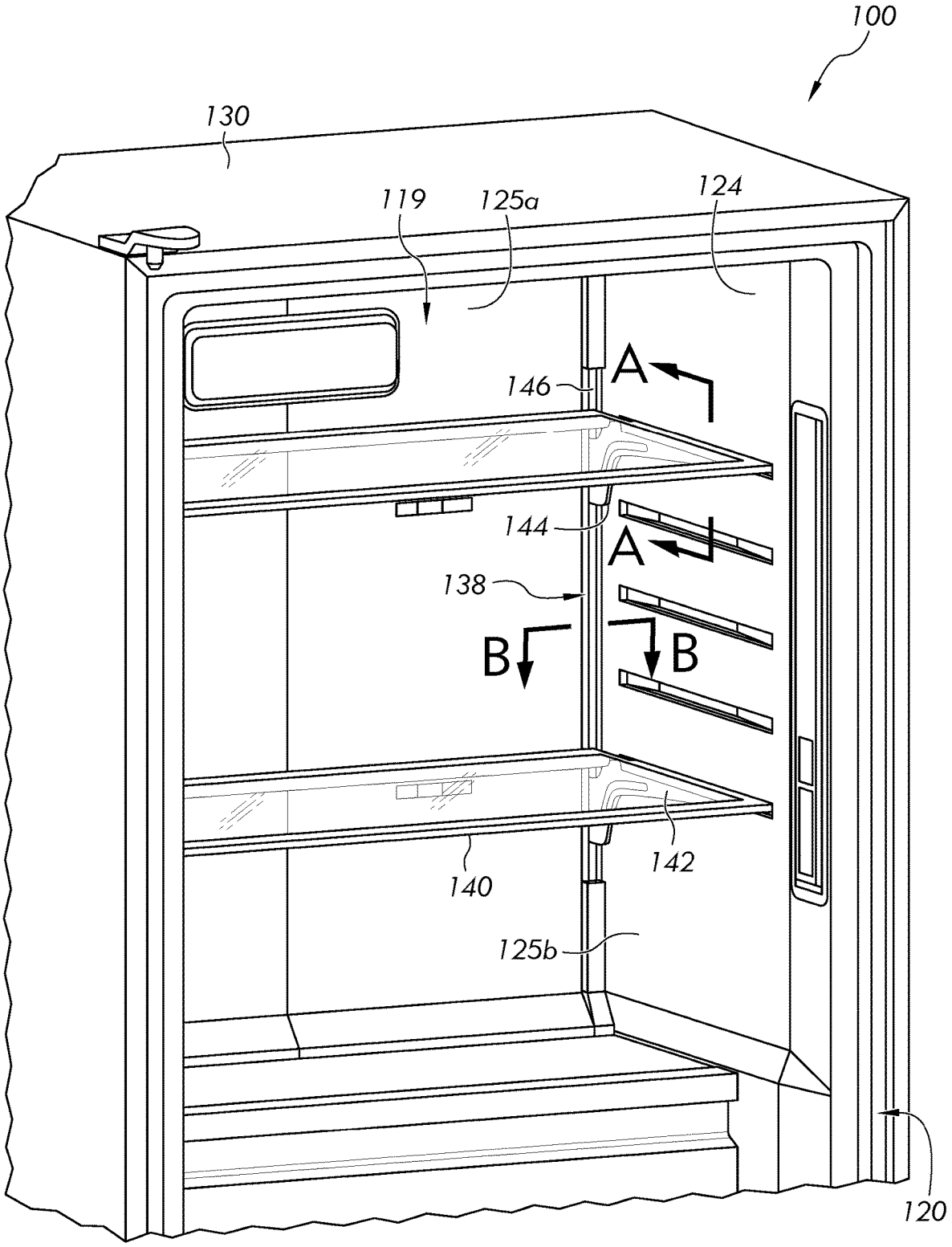
FIG. 5 is an enlarged detail view of the compartment of the refrigerator of FIG. 4.

Referring now to the drawings, FIG. 1 shows a conventional refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in FIGS. 1-3 as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc. For example, as shown in FIGS. 4 and 5, the refrigerator can be a single compartment refrigerator that has a single fresh food compartment, or a single freezer compartment. However, it is to be appreciated that the shelf support system described herein can be utilized in any configuration of a refrigerating device, or even other types of appliances where shelving is utilized.

One or more doors 16 shown in FIG. 1 are pivotally coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
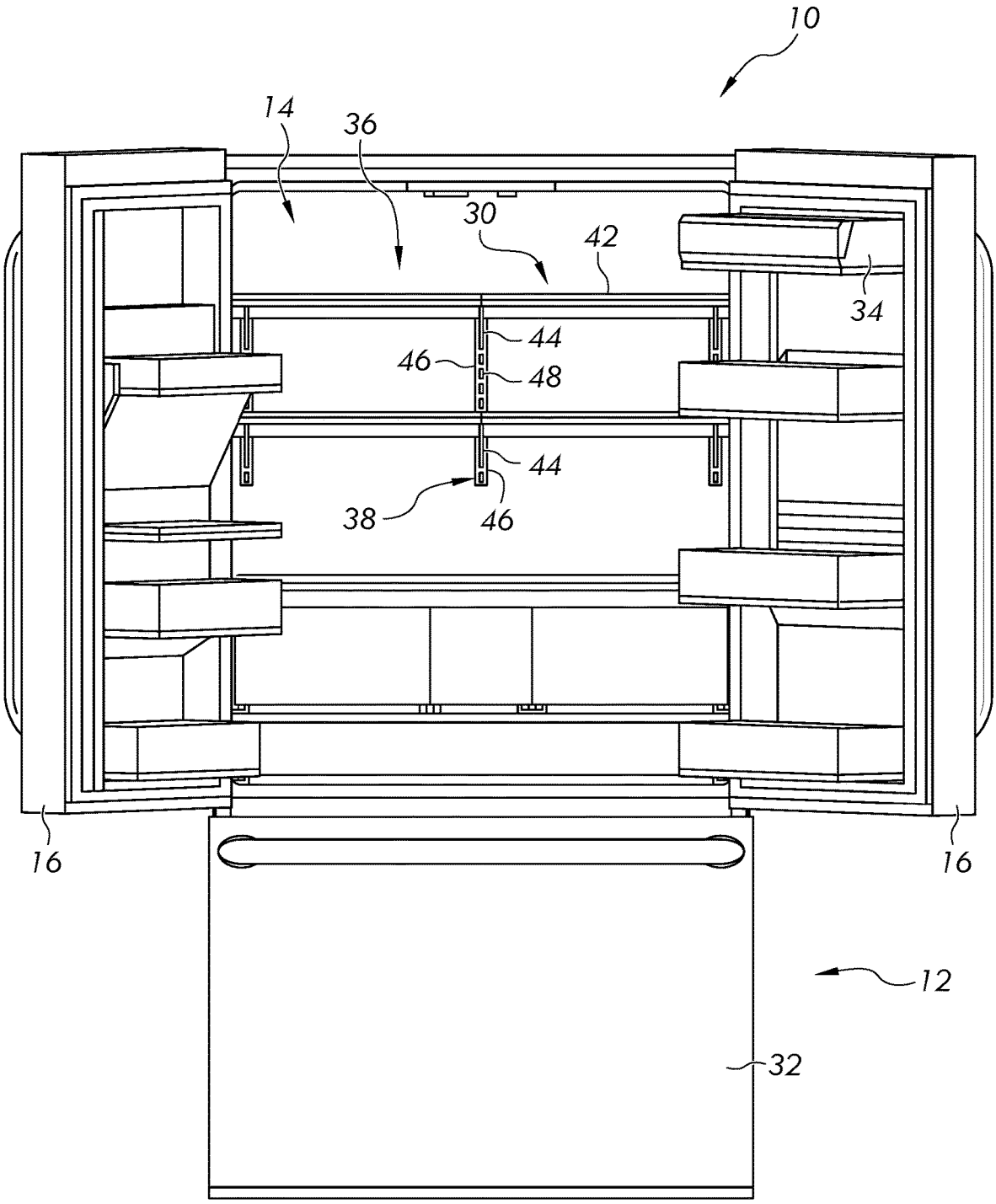
FIG. 3 (PRIOR ART)
FIG. 3 is a front view of the refrigerator of FIG. 1 showing example shelving, bins and drawers installed.

Turning next to FIG. 3, the refrigerator 10 is depicted with shelving 30 installed within the fresh food compartment 14, a drawer 32 installed in the freezer compartment 12, and bins 34 installed on the doors 16 of the fresh food compartment 14.

The shelving 30 includes a conventional shelf assembly 36 that can be removed from the fresh food compartment 14 of the refrigerator 10 while leaving a support frame 40 in place. The removable portion of the shelf assembly 36 includes a shelf panel 42 comprised of materials that are dishwasher safe. Also, since the shelf panel 42 is not permanently attached to the support frame 40, the shelf panel 42 can be taken out of the refrigerator 10 for use as a serving platter, for cleaning, or other uses.

It is contemplated that the frame 40 can be formed of a generally rigid material, such as metal, plastic or the like. In one example, the frame 40 can be formed of an injection molded plastic, and may be formed as a monolithic unit. That is, front, side and rear portions can be integrally formed as a monolithic body to define the frame 40. In other embodiments, some or all of these portions can be removably or non-removably attached to one another. The frame 40 may include additional features, such as raised or angled edges extending along the outer perimeter to retain spills.

Generally the shelf panel 42 is supported by the frame 40 and includes a planar support surface. Alternatively, one or more portions of the frame may be omitted such that at least one edge of the planar support surface of the shelf panel 42 is exposed.

It is contemplated that the shelf panel 42 can have various shapes and dimensions with the planar support surface configured to support various objects for storage. For example, the shelf panel 42 can be formed of various generally rigid materials, such as glass, plastic, metal, wire, or other suitable materials. Preferably, the shelf panel 42 comprises a generally translucent or transparent material, such as a tempered or toughened glass or polymer panel suitable for use in a refrigerated environment. The shelf panel 42 may include additional features, such as raised or angled edges extending along the outer perimeter (e.g., front, rear, and/or side edges) to provide a "spill proof" panel and/or one or more support legs to support the shelf panel 42 inside and/or outside of the appliance. Additionally or alternatively, a handle (not shown) can be removably or non-removably fixed along at least a portion of the front edge to facilitate user manipulation of the shelf panel 42.

The shelf assembly 36 is supported by a shelf support system 38 including at least one shelf support arm 44 and at least one support rail 46. The shelf support arm 44 is configured to be attached with respect to the interior liner 24 of the fresh food compartment 14 to support the shelf panel 42 therein. As shown, a pair of shelf support arms 44 can be used, with one support arm 44 located at and supporting each lateral end of the shelf panel 42. In one example, one or more of the shelf support arms 44 can include an interlocking device configured to be removably attached with respect to the interior liner 24 at a selected elevation with the shelf support arms 44 acting as a cantilever support for the shelf panel 42. In the illustrated embodiment, a plurality of ladder tracks or vertical support rails 46 are provided with an array of vertically disposed apertures 48 to allow interaction with the interlocking device to maintain the shelf assembly 36 at the desired user-selected elevation within the fresh food compartment 14 of the refrigerator 10. Preferably, the shelf support arms 44 have corresponding attachment structure to be received and retained within the apertures 48, such as hook-shaped members or the like.

Turning next to FIGS. 4 and 5, another refrigeration appliance is indicated generally at 100. The refrigeration appliance 100, also herein referred to as a refrigeration 100, is substantially similar to the refrigeration appliance 10 in that it includes at least one refrigerated compartment (either a single fresh food compartment, or a single freezer compartment), but instead includes only a single door for the compartment (not shown), and as otherwise discussed below. Aspects of the refrigerator 100 that are similar to aspects of the refrigerator 10 are identified with the same reference numbers but indexed by 100. It will be appreciated that aspects of the refrigerator 10 may be incorporated into the refrigerator 100 and vice versa. It is to be appreciated that the shelf support system described below can be utilized in any configuration of a refrigerating device, or even other types of appliances where shelving is utilized.

The refrigeration appliance 100 includes an interior liner 124 that at least partially defines an upper zone 114 and a lower zone 112. The liner 124 defines a plurality of internal walls of the upper and lower zones 114 and 112, which may jointly be referred to as the compartment. In one example, the inner liner can be a single unitary liner that defines the entire refrigerated interior compartment of the refrigeration appliance 100, which may have a single zone or multiple zones, as described. Although described as "zones", it is to be appreciated that there may or may not be any hard barriers or mullions that separate or define such zones. In the below-described example, the shelf assembly is typically installed onto a shelf support system in the upper zone 114, while drawers or other storage systems are utilized in the lower zone 112. However, it is to be appreciated that the shelf assembly and corresponding shelf support system can be used in either or both of the described zones. The internal walls of the liner 124 include a rear wall 125*a* and opposed side walls 125*b*, in addition to defining upper and lower walls of the upper and lower zones 114 and 112. It will be appreciated that the term upper and other directional or alignment designations such as lower, below, above, vertical, horizontal, etc. are provided with respect to typical alignment of the refrigeration appliance 100 while in operation.

The liner 124 may be formed by any suitable process, such as preferably by vacuum form molding, or by thermoforming or rotomolding. The liner 124 has an inner side disposed opposite an outer side and is configured, such as being shaped, to be inserted into a casing 130 and coupled to the casing 130 by any suitable method. It is understood that insulation subsequently will be installed into an insulation space formed between the liner 124 and the casing 130 to form a cabinet 119 of the refrigerator 100. The insulation typically is fluidly injected, such as foamed, into the insulation space, which is disposed about the outer side of the liner 124.

Figure 6:
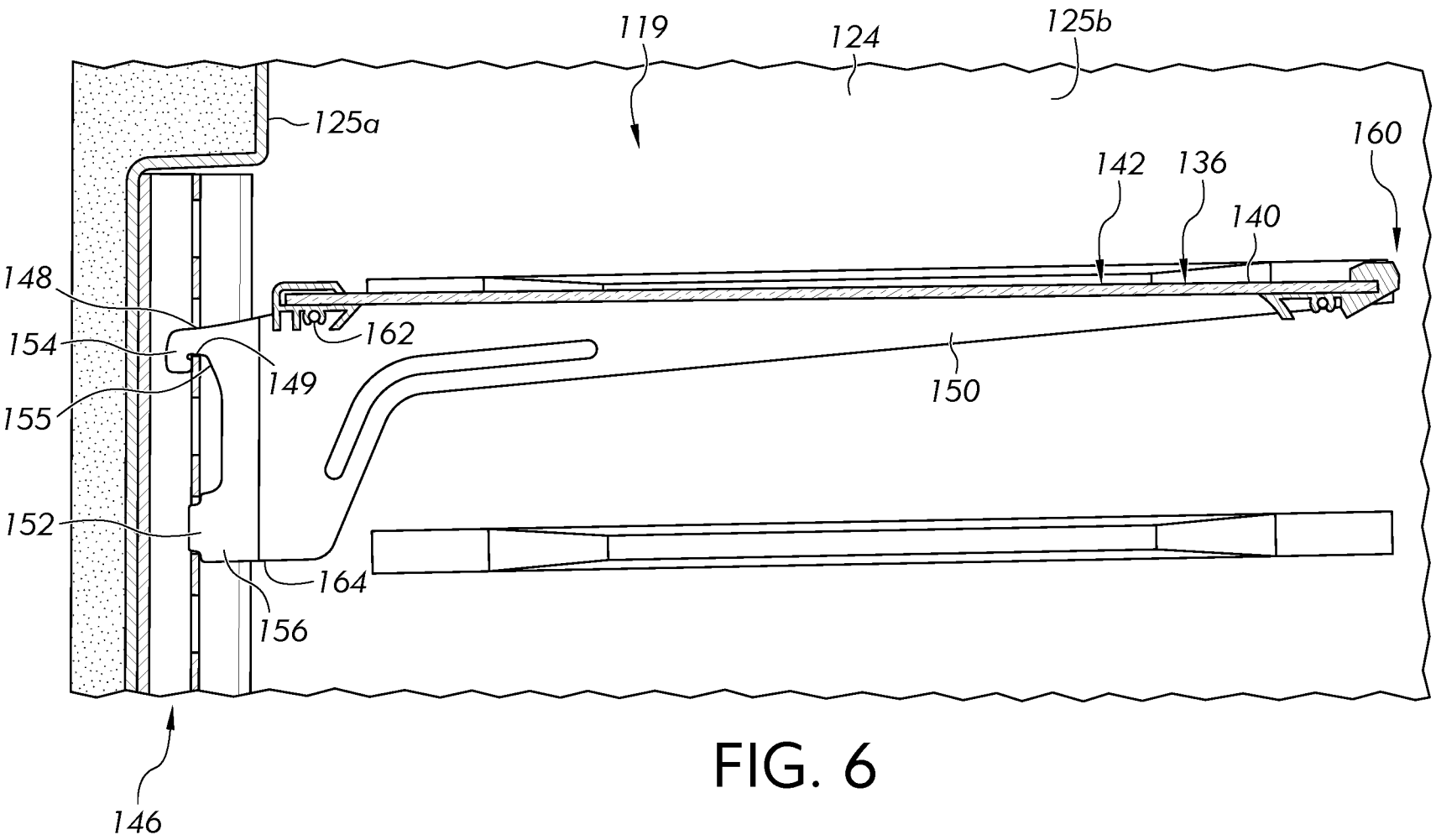
FIG. 6 is a side view of a portion of the shelf support system of FIG. 5 and taken along the line A-A of FIG. 5, with portions of the system being translucent for clarity to show engaged aspects of the support system.

As illustrated best at FIGS. 5 and 6, at least one shelf assembly 136 is installed in the upper zone 114 and is supported in a generally horizontal state by a shelf support system 138. Of course, similar shelf assemblies and corresponding shelf support systems can be utilized in the lower zone 112 if desired. Particularly as shown, a pair of individual shelf assemblies 136 are separately supported by the shelf support system 138. In other embodiments, additional or fewer shelf assemblies 136 can be supported by the shelf support system 138, and/or additional shelf support systems 138 can be included. Additionally, the location of the shelf assemblies 136 can be vertically adjusted along the shelf support system 138 within the upper zone 114.

It also is contemplated that other elements can be similarly supported by the shelf support system 138. For example, the shelf support system 138 disclosed herein also is suitable for use with a hanging bin or drawer assembly, such as a crisper bin, meat drawer, beverage rack, etc. that may or may not include a traditional "shelf."

The shelf assembly 136 includes a shelf panel 142 supported by a support frame 140, and each having a conventional configuration. Thus, for brevity, only minimal additional description of the shelf assembly 136 will be provided as otherwise corresponds to the shelf support system 138.

The shelf support system 138 includes a vertical support rail 146 coupled to the rear liner wall 125*a* and having a plurality of vertically-spaced apertures 148, and a shelf support 144, such as a shelf support arm 144, that is selectively removably mounted to the vertical support rail 146 via interlocking within the apertures 148 (FIG. 6). The shelf support system 138 is supported by the liner 124, and particularly by both the rear liner wall 125*a* and the respective side liner wall 125*b* disposed adjacent the respective vertical support rail 146, as will be further described. The shelf assembly 136 is supported in its generally horizontal position via engagement with the shelf support system 138, and specifically with the shelf support arm 144. For example, the frame 140 or the shelf panel 142 are configured to removably mount to or otherwise couple to the shelf support arm 144.

Each depicted shelf assembly 136 is supported by a pair of vertical support rails 146 and a pair of shelf support arms 144 spaced-apart from one another in a generally horizontal direction, and particularly along a lateral direction extending between the opposed side walls 125*b* of the liner 124. Each shelf support arm 144 is engaged with a respective one of the vertical support rails 146. It is noted that each of the shelf support arms 144 that are arranged to support a single shelf assembly 136 either are identical to or are generally an inverse of the other, although it is contemplated that they could be different.

Looking specifically to FIG. 6, a side view of one of the shelf support arms 144 is illustrated. The support arm 144 includes a horizontally extending cantilever portion 150 for extending inwards into the cabinet 119, such as forwards towards an opening 120 of the cabinet 119. The opening 120 is selectively closed by the respective door and is disposed opposite the rear liner wall 125*a*. An interlocking portion 152 is disposed at one end of the cantilever portion 150, such as being integral therewith. The interlocking portion 152 is configured to removably engage with a vertical support rail 146 to thereby mount the support arm 144 in a generally horizontal position relative to vertical support rail 146. In this way, the support arm 144 acts as a cantilever support for the shelf panel 142.

Specifically, the interlocking portion 152 includes at least one hangar element 154 configured to engage within a vertically disposed aperture 148 of the vertical support rail 146 to thereby maintain the respective shelf assembly 136 at a particular elevation within the cabinet 119. For example, the hangar element 154 may be a hook or other curved projection. The hangar element 154 is configured to curve downwardly when arranged at the vertical support rail 146. The hangar element 154 also is configured with a length that protrudes through an aperture 148, with an edge of a window 149 defining said aperture 148 being received into a depression 155 defined by the hangar element 154.

To further aid in stability of the support arm 144, and of a shelf assembly 136 supported by the support arm 144, the interlocking portion 152 also includes a secondary tab 156 that likewise is configured to be received into an aperture 148 of the vertical support rail 146. The secondary tab 156 is spaced from but aligned with the hangar element 154 such that the hangar element 154 and secondary tab 156 are configured to be inserted into vertically-separated apertures 148 of a vertical support rail 146. The secondary tab 156 does not include a hangar element, such as a hook. Rather, the secondary tab 156 at most minimally protrudes into a respective aperture 148 when aligned therewith. The secondary tab 156 provides lateral or side-to-side support of the support arm 144, aiding in limiting or altogether preventing rotation of the support arm 144 about axes extending generally along the cantilever portion 150.

The interlocking portion 152 is configured to be removed and to be inserted into varying ones of the apertures 148 of the vertical support rail 146 to thereby provide the respective shelf assembly 136 at an adjustable and desired elevation chosen by the user. Accordingly, to remove the shelf support arm 144 from the cabinet 119 or to adjust a vertical position of the shelf support arm 144, the user raises vertically upward a distal end 160 of the shelf support arm 144 disposed opposite the interlocking portion 152. This enables the hangar element 154 to be pulled from the respective aperture 148 to thereby disengage the vertical support rail 146.

It will be appreciated that the term upper and other directional and alignment designations such as lower, below, above, vertical, horizontal, etc. are provided with respect to typical alignment of the shelf support system 138 and shelf assembly 136 within a zone 112/114 of the refrigeration appliance 100.

Turning now to additional aspects of the shelf support arm 144, to aid in mounting of the shelf assembly 136 to the support arm 144, the cantilever portion 150 can include one or more engagement features, such as one or more protrusions 162 spaced along an upper edge of the cantilever portion 150.

Disposed between the cantilever portion 150 and the interlocking portion 152, the support arm 144 can include an intermediate bent portion 164 that is bent out of plane of either of the interlocking portion 152 or the cantilever portion 150. The bent portion 164 is shaped such that the generally planar shapes of the interlocking portion 152 and the cantilever portion 150 each extend generally parallel to but horizontally offset from one another. The bent portion 164 is provided to add additional support and stability against moments of force about the interlocking portion 152.

As depicted at least at FIG. 6, the cantilever portion 150, intermediate bent portion 164 and interlocking portion 152 are integrally formed as a monolithic unit. For example, the depicted support arms 144 are comprised of metal, such as formed steel. In one example, the shape is produced via stamping a component from a metal sheet and then conducting subsequent bending of the component.

Figure 7:
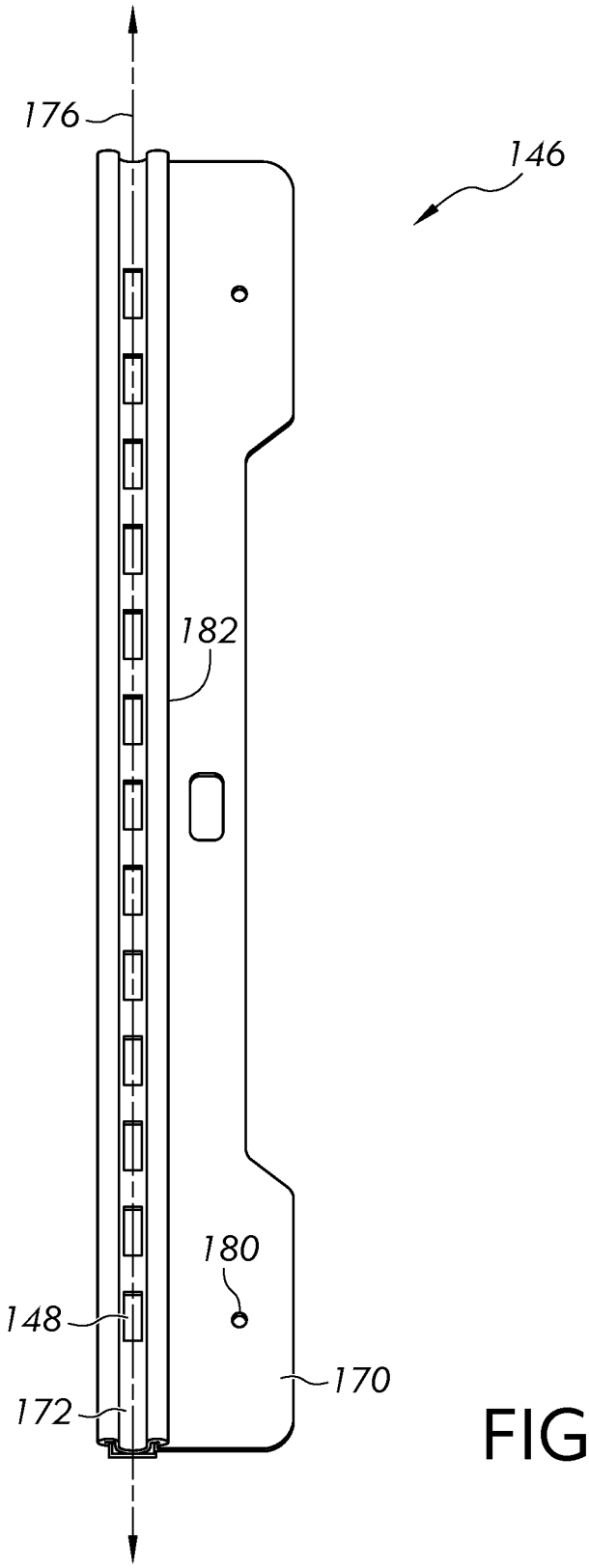
FIG. 7 is a front view of a vertical support rail of the shelf support system of FIG. 5.
Figure 8:
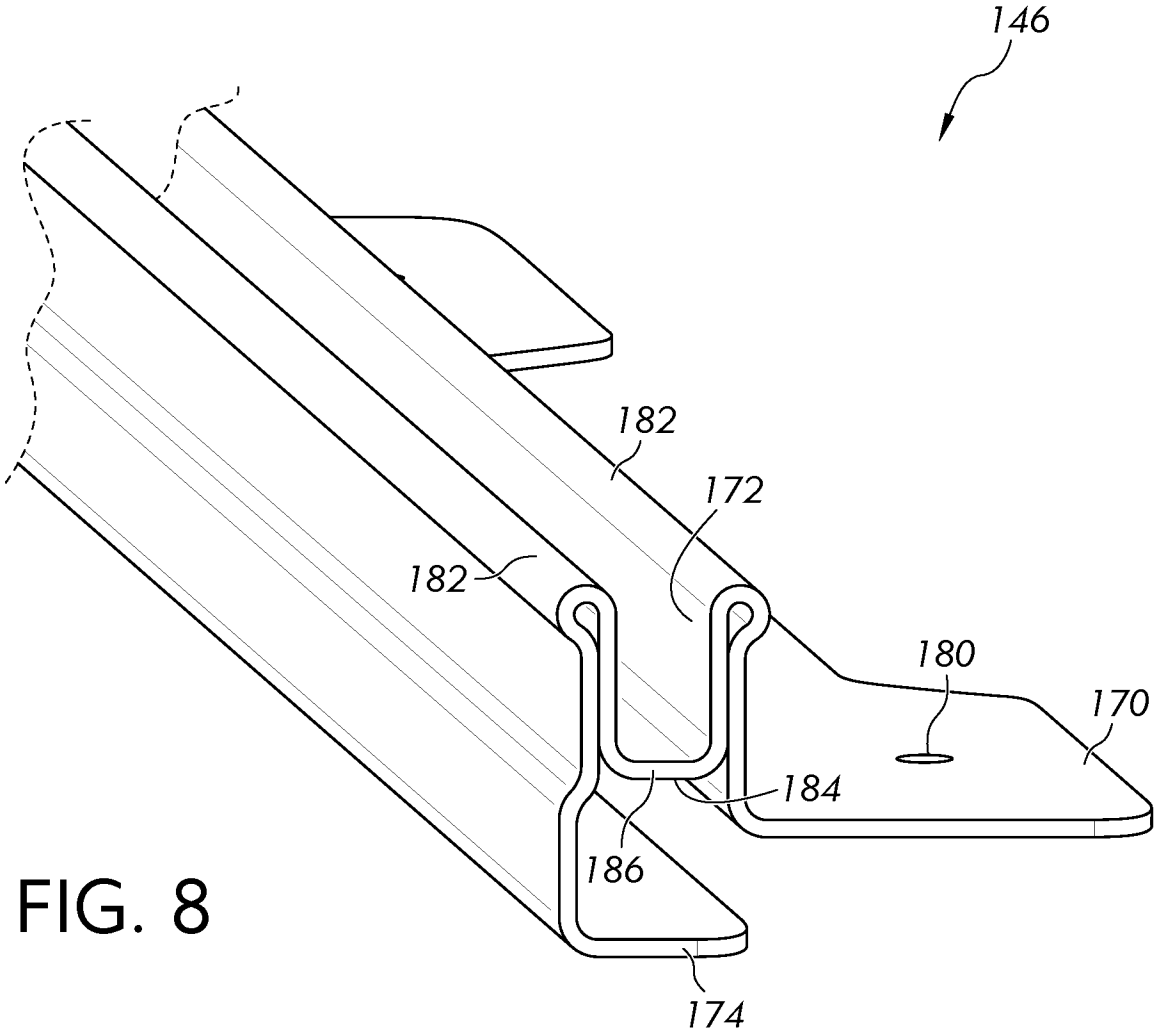
FIG. 8 is bottom perspective view of the vertical support rail shown in FIG. 7.
Figure 9:
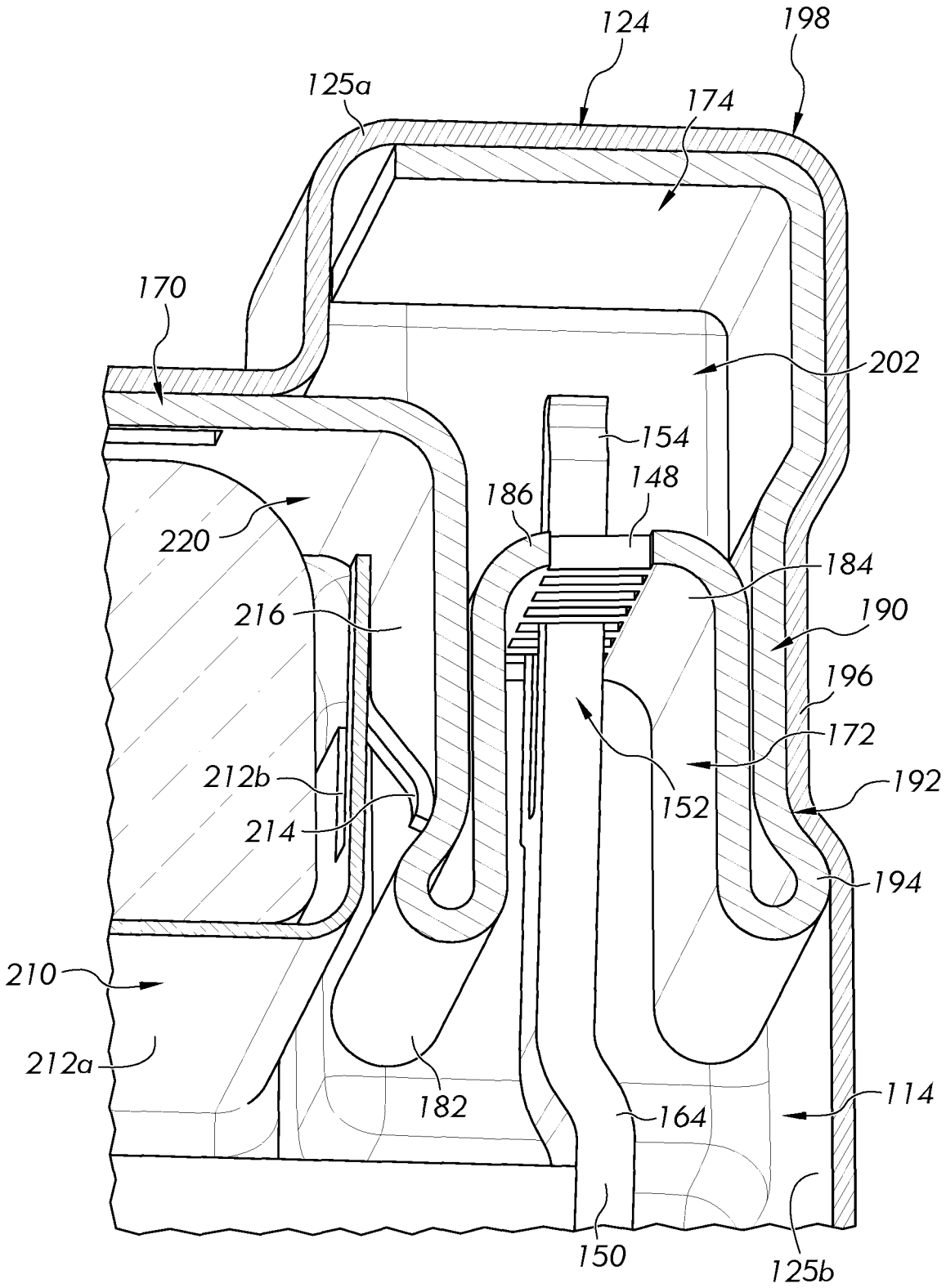
FIG. 9 a cross-sectional partial view of the shelf support system of FIG. 5 taken along the line B-B of FIG. 5.

Turning now to FIGS. 7 to 9, the vertical support rail 146 is illustrated in greater detail. Generally, as described above, the vertical support rail 146 is configured to be supported by a plurality of sides of the liner 124, to thereby enable the shelf support arm 144 to support the support assembly 136 in a cantilever manner. The vertical support rail 146 has various aspects connected to one another, including an L-shaped mounting flange 170, a U-shaped shelf support 172, and a secondary L-shaped stability flange 174. Each aspect extends generally along a majority of, and preferably, an entirety of, a longitudinal length of the vertical support rail 146, disposed along a longitudinal rail axis 176.

As depicted, these aspects are integrally formed as a monolithic unit made of metal, such as formed steel. In one embodiment, illustrated in FIGS. 7 to 9, the configuration of the vertical support rail 146 is formed by bending a stamped or cut, single metal sheet. In other embodiments, one or more of the L-shaped mounting flange 170, U-shaped shelf support 172, and secondary L-shaped stability flange 174 can be coupled to and not integrally formed with the other aspects.

Turning specifically to the bottom perspective view of FIG. 8, at a first end, the L-shaped mounting flange 170 is formed, having one or more through-holes 180 extending therethrough for receiving fasteners (e.g., screws, bolts, snaps/clips, etc.) for fastening the vertical support rail 146 to the liner 124. The fasteners are inter-fastened to the rear liner wall 125*a*. In some embodiments, the rear liner wall 125*a* can include pre-fabricated holes or alignment features for aiding in attaching the L-shaped mounting flange 170. Preferably, when installed, a majority of the L-shaped mounting flange 170 is hidden behind the false wall 210. More preferably, when installed, the through-holes 180 and the fasteners therein are hidden behind the false wall 210 and are not visible to a user.

The bent configuration of the vertical support rail 146 next proceeds to the U-shaped shelf support 172. This aspect forms the inward-most extent of the vertical support rail 146 along a direction proceeding from the liner into the zones 112/114 defined by the liner 124, with the rear liner wall 125*a* being relatively more outward (in a direction towards the casing 130). In the particular arrangement depicted, the U-shaped shelf support 172 defines the most frontward extent of the vertical support rail 146.

This frontward extent is defined by a pair of opposed, rounded vertical-extending edges 182 at the distal ends 184 of the U-shape. The base of the U-shape is an apertured mounting wall 186 having the plurality of vertically-separated apertures 148 for receiving the hangar element 154 and secondary tab 156.

As shown in FIG. 9, a lateral side 190 of the U-shaped shelf support 172, opposite the L-shaped mounting flange 170, provides a laterally-facing groove 192. The groove 192 is rearward (or outward) of a respective rounded edge 182, which itself provides a laterally-facing ridge 194. This ridge 194 and groove 192 provide laterally-facing mating features that extend along a majority of a vertical extend of the vertical support rail 146 along the longitudinal rail axis 176.

These features are provided for mating with corresponding mating features, such as inverse mating features, of a liner wall adjacent the rear mounting liner wall 125*a*, and specifically with mating features of a respective side liner wall 125*b*. The mating features of the side liner wall 125*b* include at least a vertically-extending ridge 196 for mating within the groove 192 of the vertical support rail 146. That is, the vertical support rail 146 is supported by at least a pair of transversely-opposed, adjacent liner walls 125*a*, 125*b*. The rail 146 is fixed to the rear liner wall 125*a* (via flange 170) and is also in non-fixed engagement with the side liner wall 125*b*. This dual support provides additional stability over conventional rail attachment only to a rear liner wall.

Turning to FIG. 9, in addition to FIG. 8, the secondary L-shaped stability flange 174 extends rearward (or outward) of the U-shaped shelf support 172. This flange 174 is received into a vertically-extending recess 198 (also herein referred to as a depression) at the liner 124. In this way, disposition of the flange 174 allows for additional transfer of load of the shelf support system 138 to the cabinet liner 124 and insulation disposed outward of the liner 124. FIG. 9 particularly illustrates the recess 198 as being at the rear liner wall 125*a*, and particularly at a corner of the liner 124 at an intersection of the rear liner wall 125*a* and a respective side liner wall 125*b*. In some embodiments, the secondary L-shaped stability flange 174 can be fixed to the liner 124, such as to the rear liner wall 125*a*, by any suitable fastening method.

A vertically-extending pocket 202 is formed at least partially by the L-shaped stability flange 174, between the flange 174 and the apertured mounting wall 186. This pocket 202 is disposed at least partially rearward (or outward) of the L-shaped mounting flange 170 and provides space for receipt of the hangar element 154. A distal tip of the hangar element 154 may extend rearward beyond a major visible surface of the rear liner wall 125*a* and into the pocket 202 at the recess 198. This configuration of the vertical support rail 146 and recess 198 allows for the mounting wall 186 to be disposed out of view of the user and also to increase usable space within the zones 112/114.

In addition to the foregoing, other configurations of the vertical support rail 146 may be suitable. For example, in some embodiments, the L-shaped stability flange may be received at least partially into a respective side liner wall 125*b*. In some embodiments, the secondary L-shaped stability flange 174 may be omitted, and in others may be otherwise shaped or provide a rearward extent that does not extend beyond the L-shaped mounting flange 170. In some embodiments the L-shaped mounting flange 170 may be attached to a side liner wall 125*b* of the liner 124, and the rear liner wall 125*a* may mate with the mating features of the lateral side 190 of the vertical support rail 146.

Looking still to FIG. 9, and also to FIG. 5 as a reference, the refrigeration appliance 100 includes a panel structure, such as a false wall 210, extending vertically along and inward of at least one wall of the liner 124. In one embodiment, as shown in the figures, the false wall 210 is disposed forward of the rear liner wall 125*a*, so that the false wall is visible to the user of the refrigeration appliance 100 while a majority, such as substantially all, of the rear liner wall 125*a* is hidden from view. The false wall 210 may be decorative, and/or may provide additional functionality, such as an air plenum for an air tower that discharges cooled air via outlets into the upper and/or lower zones 114/112 to thereby cool the interior of the refrigeration appliance 100. The false wall 210 includes a main front panel portion 212*a* and opposed side portions 212*b* extending rearward from the front panel portion 212*a*. The false wall 210 is supported at least partially in vertical alignment via engagement with a vertical support rail 146, and particularly between a pair of vertical support rails 146.

To provide this support, the false wall 210 includes a protrusion received in a depression of the vertical support rail 146. As illustrated at FIG. 9, the false wall 210 includes a fastener, such as a spring element 214 engaging an inner lateral wall 216 of the vertical support rail 146. The inner lateral wall 216 is shown as a portion of the L-shaped mounting flange 170. Particularly, the spring element 214, such as a spring clip, is engaged rearward of a respective rounded edge 182. As can be appreciated, the false wall 210 can utilize additional or alternative protrusions and/or fasteners along its vertical length to provide adequate support within the compartment.

The false wall 210 defines a cavity 220 disposed between the false wall 210 and the liner 124, which cavity 220 may contain any of a cooling tower, wiring, tubing, an evaporator, venting, etc. The false wall 210 also conceals at least a portion of the shelf support system 138 by which it is supported. At least a portion of the L-shaped mounting flange 170 is concealed rearward (or outward) of the false wall 210. The vertical support rail 146 also includes the wall of the rounded edge 182 being the forward-most (or inward-most) extent of the vertical support rail 146, which extent is disposed generally flush with or rearward of an inward-most face of the front panel portion 212*a*. Further, as depicted, the mounting wall 186 is disposed rearward, though laterally, of the false wall 210, and particularly rearward of a front-most face of the front panel portion 212*a* of the false wall 210.

In view of the foregoing arrangement of the vertical support rail 146, false wall 210, and liner 124, visibility of the apertures 148 to the user at the opening of the refrigeration appliance 100 is at least partially reduced. Moreover, the concealing of portions of the shelf support system 138 provides a recessed and fluid appearance of the rear of the cabinet to the user, while also maximizing storage space within the zones 112/114.

In some embodiments, an additional or alternative false wall may extend along a different internal wall of the zones 112/114, while still concealing at least a portion of the shelf support system 138.

Figure 10:
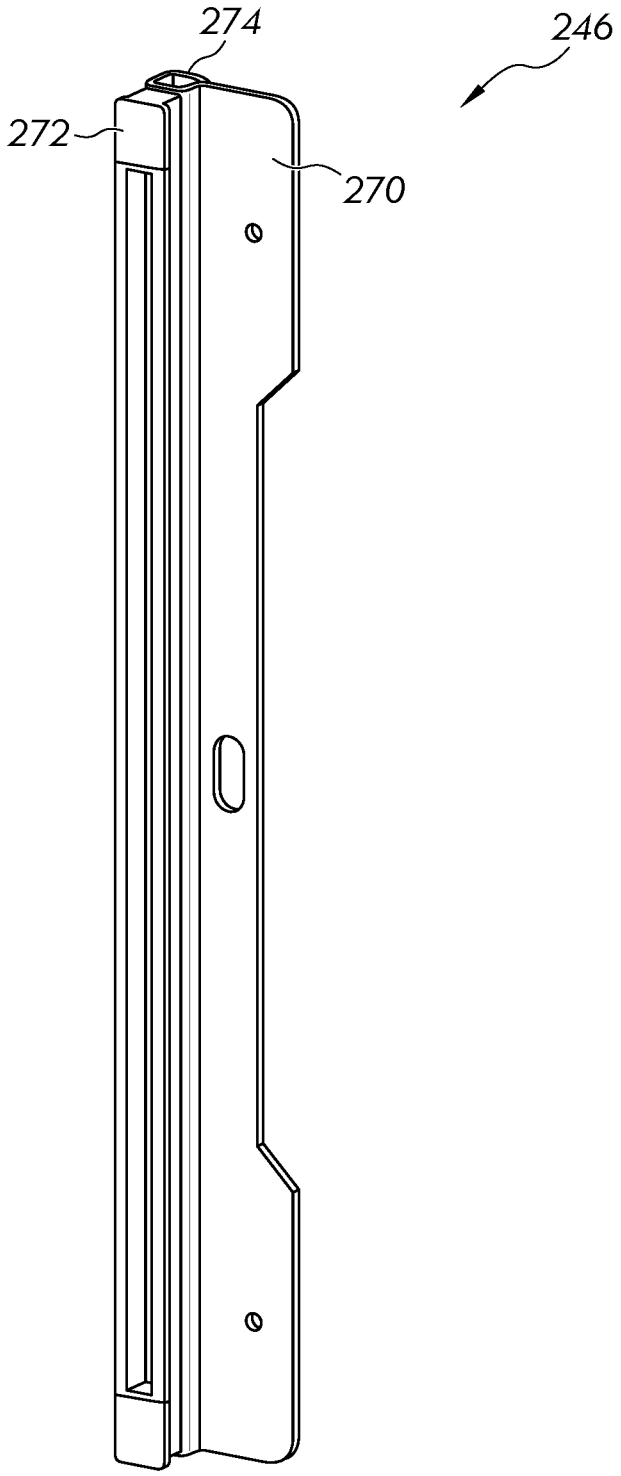
FIG. 10 is a front perspective view of another embodiment vertical support rail different from that depicted in FIGS. 4 to 9.
Figure 11:
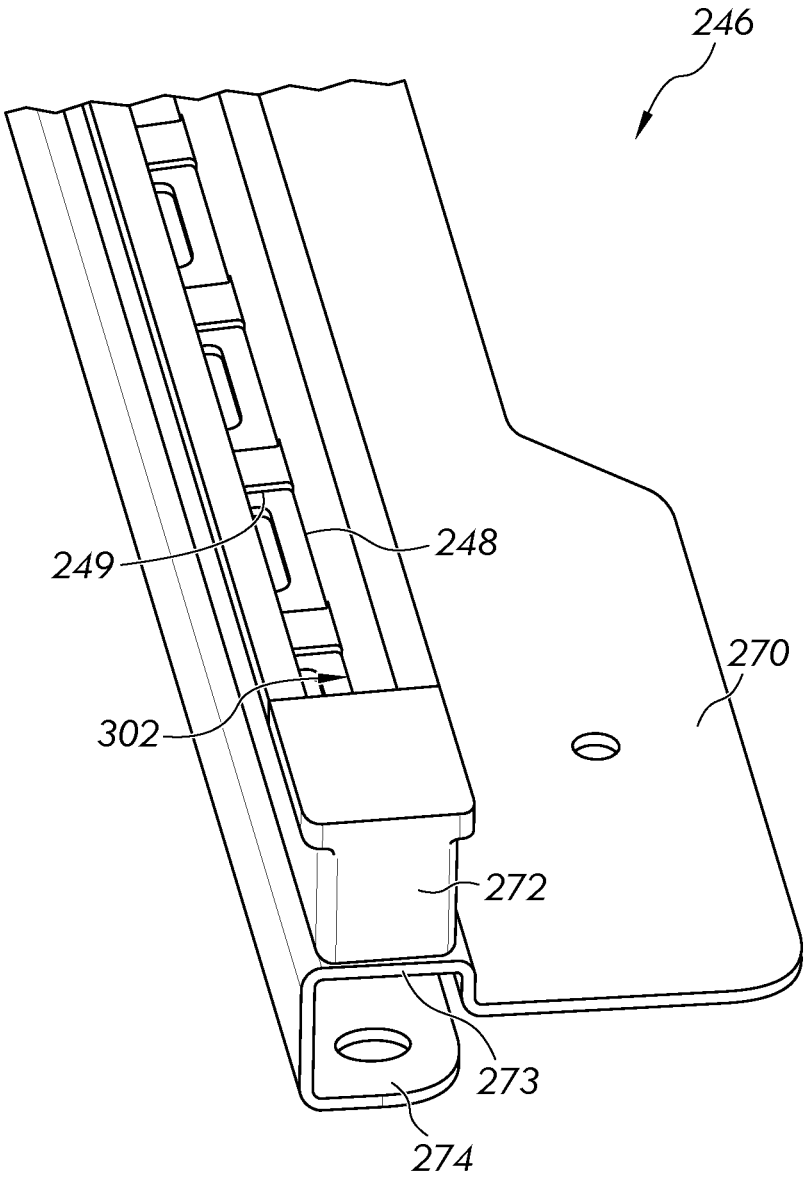
FIG. 11 is an enlarged front perspective view of one end of the vertical support rail of FIG. 10.
Figure 12:
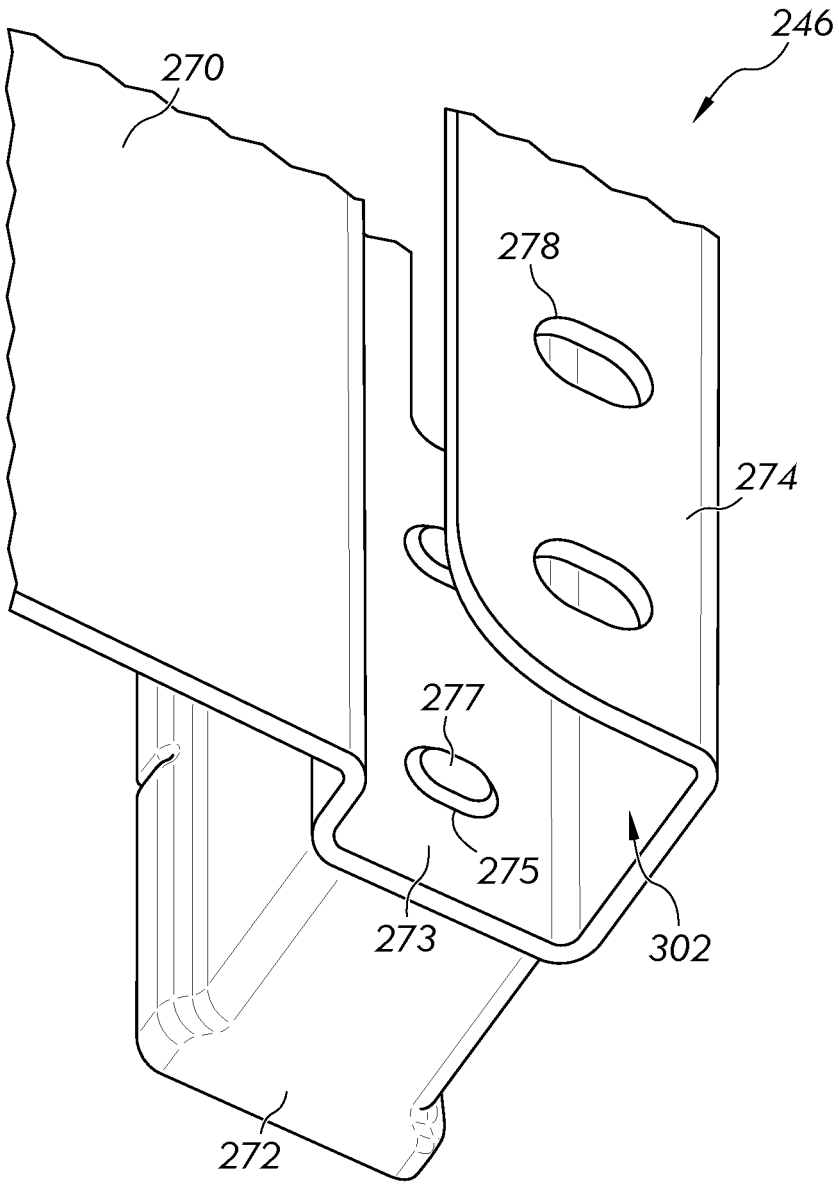
FIG. 12 is an enlarged rear perspective view of one end of the vertical support rail of FIG. 10.

Turning now to FIGS. 10 to 12, another embodiment of a vertical support rail is depicted at 246 and can be used for supporting the shelf support arm 144. The vertical support rail 246 is substantially similar to the vertical support rail 146 in that it includes mounting flanges and an apertured wall, and as otherwise discussed below. Aspects of vertical support rail 246 that are similar to aspects of the vertical support rail 146 are identified with the same reference numbers but indexed by 100. It will be appreciated that aspects of the vertical support rail 246 may be incorporated into the vertical support rail 146 and vice versa.

The vertical support rail 246 includes an L-shaped mounting flange 270, U-shaped shelf support 272, and a secondary support flange 274. Preferably, these elements are comprised of metal, such as formed steel. However, different from the vertical support rail 246, the U-shaped shelf support 272 is separately formed from a remainder of the vertical support rail. Thus, the L-shaped mounting flange 270 and secondary support flange 274 can be one unitary element, while the U-shaped shelf support 272 is a second unitary element. In this way, the shelf support 272 can be composed of an alternate material, such as injection-molded plastic, and can, for example, be molded or extruded, among other suitable manufacturing methods. Due to the plastic construction, one or more internal support braces 249 can extend across the interior walls of the U-shaped shelf support 272 to limit movement or outward deflection thereof, and such braces 249 can define one or more apertures 248 along the length of the U-shaped shelf support 272.

The depicted vertical support rail 246 includes the shelf support 272 being coupled to an intermediate portion 273, disposed between the flanges 270 and 274, such as by heat-staking, sonic welding, or mechanical fasteners, where the shelf support 272 is composed of plastic. Preferably the coupling will fixedly secure the vertical support rail 246 and shelf support 272 together, and more preferably in a non-removable manner. That is, the intermediate portion 273 includes through-holes 275, and protrusions 277 of the shelf support 272 are received therethrough and deformed into attachment, such as by partial melting of the protrusions 277 so that they are securely attached similar to a rivet. Optionally, the flange 274 may also have corresponding and aligned holes 278 (FIG. 12) to enable manufacturing tools to reach the rear of the protrusions 277 to apply the heat staking, sonic welding, or other fastening technique. In another option, a solid or otherwise opaque end cap (not shown) can be provided at the top and/or bottom of the vertical support rail 246 either above and/or below the U-shaped shelf support 272 to thereby hide the through-holes 275 and protrusions 277 or other structure from the view of the user, and/or to provide a more visually pleasing design. Additionally, it is to be appreciated that the refrigerator shelves are still structurally supported by the metal portion of the vertical support rail 246, such as by a plurality of vertically-spaced apertures 251 (i.e., similar to apertures 148) in the intermediate portion 273. A shelf support arm 144 can thus be selectively removably mounted to the vertical support rail 246 via interlocking within the apertures 249-251 in the intermediate portion 273. Similar to the previous embodiment, the interlocking portion 152 of the shelf support arm 144 includes the least one hangar element 154 configured to engage within a vertically disposed aperture in the intermediate portion 273 of the vertical support rail 246 to thereby maintain the respective shelf assembly at a particular elevation within the cabinet 119. It is to be appreciated that the least one hangar element 154 will also pass through the interior of the U-shaped shelf support 272 and possibly through an aperture 251 thereof.

Figure 13:
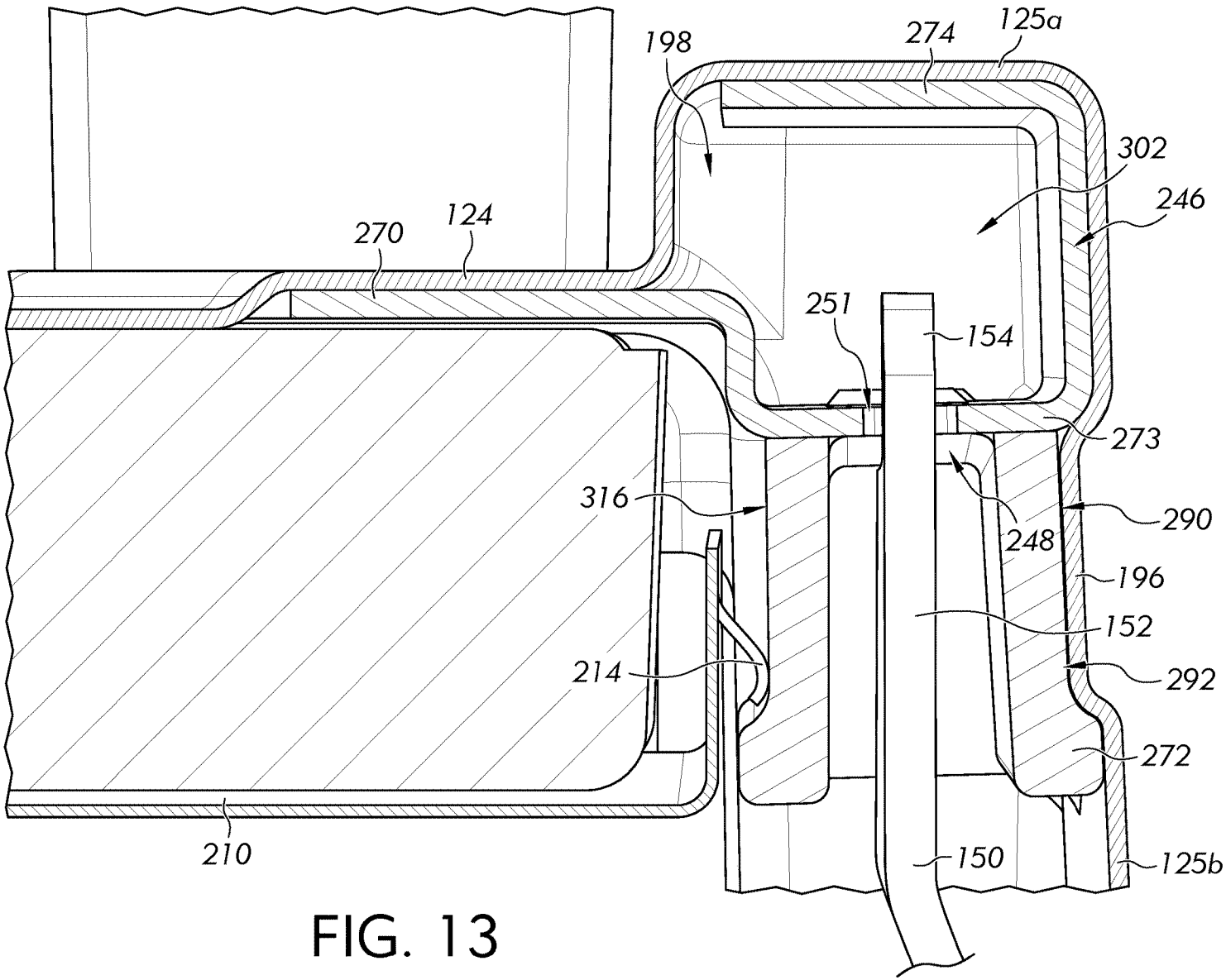
FIG. 13 similar to FIG. 9, but illustrating the vertical support rail embodiment of FIG. 10.

Additionally, as shown in FIG. 13, a pocket 302 is defined rearward of the aperture(s) 248 of the shelf support 272 and forward of the intermediate portion 273. The pocket 302 is received in the vertically-extending recess 198 at the liner 124 and provides space for receipt of the distal tip of the hangar element 154. The L-shaped mounting flange 270 is located behind the false wall 210, and as before, a majority of the vertical support rail 246 is hidden from view of the user. Similar to the first embodiment, the mating features of the side liner wall 125*b* include at least a vertically-extending ridge 196 for mating within the groove 292 on the lateral side 290 of the vertical support rail 246. That is, the vertical support rail 246 is supported by at least a pair of transversely-opposed, adjacent liner walls 125*a*, 125*b*. The rail 246 is fixed to the rear liner wall 125*a* (via fasteners received in through holes of the flange 270, which through holes are preferably hidden behind the false wall) and is also in non-fixed engagement with the side liner wall 125*b*. This dual support provides additional stability over conventional rail attachment only to a rear liner wall. Additionally, similar to the first embodiment, the false wall 210 includes the fastener, such as a spring element 214 engaging an inner lateral wall 316 of the vertical support rail 246.

In summary, provided is a refrigeration appliance 100 having a cabinet 119 defining a storage zones 112/114 therein with one or more shelves 140/142 supported in the zones 112/114. A false wall 210 is provided adjacent an internal wall 125*a* of the zones 112/114 to conceal aspects of a support system 138 that supports both the false wall 210 and the one or more shelves 140/142 within the zones 112/114, via inter-engagement of the support system 138 with the internal wall 125*a* and with another internal wall 125*b* disposed adjacent the internal wall 125*a*. A wall 186 of the support system 138 including a plurality of mounting holes comprising the vertically spaced apertures 148 is retained outward of a major inward face of the false wall 210 to provide a recessed and fluid appearance of the side of the interior of the zones 112/114 having the internal wall 125*a*.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A refrigeration appliance comprising:

a cabinet defining a storage compartment therein for storing food items in a cooled environment;

a door coupled relative to the cabinet for selectively closing an opening of the compartment;

a liner defining at least one liner wall of the compartment;

a vertical support rail coupled to the at least one liner wall;

a shelf support selectively removably mounted to the vertical support rail;

a shelf panel supported generally horizontally on the shelf support; and a false wall extending along the at least one liner wall and disposed inward of the at least one liner wall within the compartment;

wherein the vertical support rail is disposed majoratively outward of an inward-most face of the false wall, wherein a first portion of the vertical support rail includes an apertured wall having a plurality of vertically-spaced apertures for receiving a protrusion of the shelf support and an L-shaped mounting flange for mounting against the at least one liner wall, and a second portion of the vertical support rail includes a U-shaped shelf support; and wherein the first and second portions of the vertical support are formed of separate elements that are secured together.

2. The refrigeration appliance of claim 1, wherein the vertical support rail includes the plurality of vertically-spaced apertures for receiving the protrusion.

3. The refrigeration appliance of claim 1, further including another vertical support rail coupled to the at least one liner wall, the another vertical support rail being spaced in a generally horizontal direction from the vertical support rail, and another shelf support selectively removably mounted to the another vertical support rail.

4. The refrigeration appliance of claim 1, wherein the vertical support rail includes the apertured wall having the plurality of vertically-spaced apertures for receiving the protrusion of the shelf support, and wherein the apertured wall is disposed outward of the inward-most face of the false wall.

5. The refrigeration appliance of claim 1, wherein the vertical support rail has an inward-most extent facing a center of the compartment, which inward-most extent is generally flush with or outward of a major inward face of an inward panel portion of the false wall.

6. A refrigeration appliance comprising:

a cabinet defining a storage compartment therein for storing food items in a cooled environment;

a door coupled relative to the cabinet for selectively closing an opening of the compartment;

a liner defining at least one liner wall of the compartment;

a vertical support rail coupled to the at least one liner wall, wherein the vertical support rail comprises a frontward extent with a rounded vertical-extending edge that defines a recessed groove rearward of the rounded edge;

a shelf support selectively removably mounted to the vertical support rail;

a shelf panel supported generally horizontally on the shelf support; and a false wall extending along the at least one liner wall and disposed inward of the at least one liner wall within the compartment;

wherein the vertical support rail is disposed majoratively outward of an inward-most face of the false wall, wherein the false wall is at least partially supported in vertical alignment by engagement with the vertical support rail, and wherein the false wall includes a resilient spring clip received into the groove defined at an external periphery of the vertical support rail such that when the false wall is at an installed state within the refrigeration appliance the resilient spring clip is provided in a biased state, external to the vertical support rail.

7. A refrigeration appliance comprising:

a cabinet defining a storage compartment therein for storing food items in a cooled environment;

a liner defining at least one liner wall and an adjacent liner wall of the compartment disposed adjacent the at least one liner wall;

a vertical support rail coupled to the at least one liner wall;

a shelf support selectively removably mounted to the vertical support rail and extending inward of the at least one liner wall into the compartment; and a shelf panel supported generally horizontally on the shelf support;

wherein the vertical support rail is supported in vertical alignment via engagement with both the at least one liner wall and with the adjacent liner wall, wherein the vertical support rail and the adjacent liner wall each have mating features corresponding to and mating with one another;

wherein an inward-most extent of the vertical support rail is defined by a rounded vertically-extending edge providing an outward-facing ridge and at least partially defining a groove adjacent thereto, each for mating with the adjacent liner wall.

8. The refrigeration appliance of claim 7, wherein engagement of the vertical support rail with the adjacent liner wall is non-fixed.

9. The refrigeration appliance of claim 7, wherein the mating features of the vertical support rail extend along a majority of a vertical extent of the vertical support rail.

10. The refrigeration appliance of claim 7, wherein the vertical support rail includes an L-shaped mounting flange for mounting against the at least one liner wall and a U-shaped shelf support for having the shelf support mounted thereto.

11. The refrigeration appliance of claim 7, wherein the vertical support rail defines a vertically-extending pocket for receiving therein aspects of the shelf support mounted thereto, and wherein the pocket is disposed outward of a support flange of the vertical support rail that is coupled to the at least one liner wall.

12. The refrigeration appliance of claim 7, wherein the at least one liner wall includes a vertically-extending depression receiving therein a vertically-extending support flange of the vertical support rail.

13. The refrigeration appliance of claim 7, wherein the shelf support includes a hangar element and a secondary tab that each are received into the vertical support rail.

14. A refrigeration appliance comprising:

a cabinet defining a storage compartment therein with one or more shelves supported in an interior of the compartment, and a false wall provided adjacent an internal wall of the compartment to conceal aspects of a support system that supports both the false wall and the one or more shelves within the compartment, via inter-engagement of the support system with the internal wall and with another internal wall disposed adjacent the internal wall, wherein the support system comprises a frontward extent with an enlarged vertical-extending edge that defines a recessed groove rearward of the enlarged edge, and wherein the false wall includes a spring clip that is biasedly received and retained within the groove against an external periphery of the support system when the false wall is at an installed state within the refrigeration appliance.

15. The refrigeration appliance of claim 14, wherein a mounting wall of the support system includes a plurality of mounting holes and is retained outward of a major inward face of the false wall to provide a recessed and fluid appearance of a side of the interior of the compartment having the internal wall.

16. The refrigeration appliance of claim 14, further including a pair of vertical support rails spaced-apart from one another along a lateral direction extending across the storage compartment.

17. The refrigeration appliance of claim 16, wherein engagement of the pair of vertical support rails with the internal wall is fixed, and engagement with the another internal wall is non-fixed.

* * * * *